US007017991B1

(12) United States Patent
Zin

(10) Patent No.: US 7,017,991 B1
(45) Date of Patent: Mar. 28, 2006

(54) FOLDING LOUNGE CHAIR

(75) Inventor: Tsai Shaw Zin, Shenzhen Guangdong (CN)

(73) Assignee: H2O Furnishings LLC, Brookline, MA (US)

( * ) Notice: Subject to any disclaimer, the term of this patent is extended or adjusted under 35 U.S.C. 154(b) by 0 days.

(21) Appl. No.: 11/033,362

(22) Filed: Jan. 11, 2005

(30) Foreign Application Priority Data

Aug. 4, 2004 (CN) ..... 2004300766978
Aug. 24, 2004 (CN) ..... 2004200851956

(51) Int. Cl.
*A47C 3/02* (2006.01)

(52) U.S. Cl. ..... 297/271.6

(58) Field of Classification Search ..... 297/34, 297/16.1, 271.6, 258.1, 452.18, 378.1, 411.44, 297/411.28, 411.32, 271.5; 16/221
See application file for complete search history.

(56) References Cited

U.S. PATENT DOCUMENTS

| | | | | |
|---|---|---|---|---|
| 2,803,291 | A * | 8/1957 | Meyer | 297/452.13 |
| 3,526,429 | A * | 9/1970 | Metzger | 297/271.5 |
| 3,601,844 | A * | 8/1971 | Bodine | 16/370 |
| 4,887,866 | A * | 12/1989 | Rusin | 297/411.38 |
| 4,919,481 | A * | 4/1990 | Garabedian | 297/271.6 |
| 5,016,941 | A * | 5/1991 | Yokota | 297/452.61 |
| 5,090,769 | A * | 2/1992 | Wade | 297/258.1 |
| 6,752,458 | B1 * | 6/2004 | Rivera | 297/258.1 |

* cited by examiner

*Primary Examiner*—Milton Nelson, Jr.
(74) *Attorney, Agent, or Firm*—Katten Muchin Rosenman LLP

(57) ABSTRACT

A lounge chair is configured with backrest and seat frames operative to pivot relative to one another between erected and folded positions. In the erected position of the lounge chair, inner end surfaces of longitudinal members of the seat frame each extend complementary to, abut and support a respective inner surface of longitudinal members of the backrest seat.

14 Claims, 5 Drawing Sheets

FOLDING LOUNGE CHAIR

CROSS-REFERENCE TO RELATED APPLICATION

This application is based on and claims priority to Chinese Patent Application Ser. Nos. 2004200851956 and 200400766978 filed on Aug. 4, 2004 and fully incorporated herein by reference.

BACKGROUND OF THE INVENTION

Field of the Invention

The present invention relates to chairs and, more particularly, to lounge chairs that are capable of being folded for transportation and storage.

Background

The concept of producing furniture that can be easily transported by a distributor to effect efficient shipping costs and by a user for ease of transporting after purchase and for tucking away once in the household has become increasingly popular.

A common piece of furniture is video lounge chair used by teens, tweens and their parents to watch TV in a family room or for their older siblings to use to furnish their dorm rooms. Such chairs are preferably low to the ground having no legs, comfortable to relax in to watch the latest installment of a popular series or a new video game, and tend to affect a sense of informality.

Some video lounge chair designs are primarily geared towards comfort, whereas such concerns as space management and flexibility often escape the designer's attention. These chairs are constructed as rigid, unitary structures made from wood, bamboo and/or steel and typically are cumbersome and heavy. Accordingly, moving such chairs around in a house or shipping or transporting them is not easy. Thus, if a need exists for storing even a single lounge chair, it will occupy a substantial amount of storage space.

Other designs that do go beyond comfort and aesthetics and take into consideration such concerns as portability employ complicated structural assemblies, which may often malfunction.

Moreover, all types of chair designs are too often limited to traditional designs where chairs are disposed remain static. Static chairs have a propensity for making their occupants feel deprived of an opportunity to stir about, shift their weight, or just plain fidget. In contrast, chairs such as rocking chairs relieve at least some of that frustration.

When applied to video lounge chairs, chairs that are static limit the opportunity of the occupants to truly relax. Thus, it is preferred that the occupant has some opportunity to move when seated. Borrowing from the rocking chair, there are suggestions to employ means to allow the video lounge chair to rock. However, such chairs are notoriously difficult to enter from a standing position and easy exit from the seated portion.

Thus, there exists a need for a video lounge chair formed with a minimal number of components that are foldable to assume a structure, which is easily transportable and occupies a small amount of space. Another need exist for the lounge chair that has an ergonomically configured and stable structure.

A further need exists for the video lounge chair provided with a coupling unit for converting the erected position of the lounge chair to the collapsed or folded position thereof, and conversely in a simple and time-efficient manner.

Another need exists for the video lounge chair to be relaxing and entertaining.

Yet a further need exists for the video lounge chair to be easy to enter from a standing position and easy to exit from a seated position. A need exists for the structure of the video lounge chair to accommodate such desires.

SUMMARY OF THE INVENTION

The present invention is directed to a lounge chair that meets these needs. Configured of two major parts, seat and backrest fames, the inventive lounge chair is operative to fold between an erected position, in which the backrest and seat frames extend transversely to one another, and a folded or collapsed position, in which both the backrest and seat frames extend in substantially parallel planes. Accordingly, a person user can relatively easily displace the folded lounge chair around his/her house or apartment and store it without occupying too much space.

A coupling unit, configured to provide the backrest and seat frames with pivoting motion, includes a plurality of J- or L-shaped hinges, each pair of which is rotatably mounted on a respective pin. The pin extends through bent ends of hinges and allows for a wide range of pivotal motion between the frames. As a result, the backrest frame can lie atop the seat frame in the collapsed position of the lounge chair.

Inner end portions of the frames are configured so that in the erected position of the frames, the end portions of the backrest frame are abutted by the end portions of the seat frame so as to provide the inventive lounge chair with necessary stability. Accordingly, no additional mechanical assemblies are required to maintain the erected position of the lounge chair. As a result, the inventive lounge chair is cost-effective and has a simple structure.

These and other features and aspects of the present invention will be better understood with reference to the following description, figures, and appended claims.

DETAILED DESCRIPTION

Figure 1:
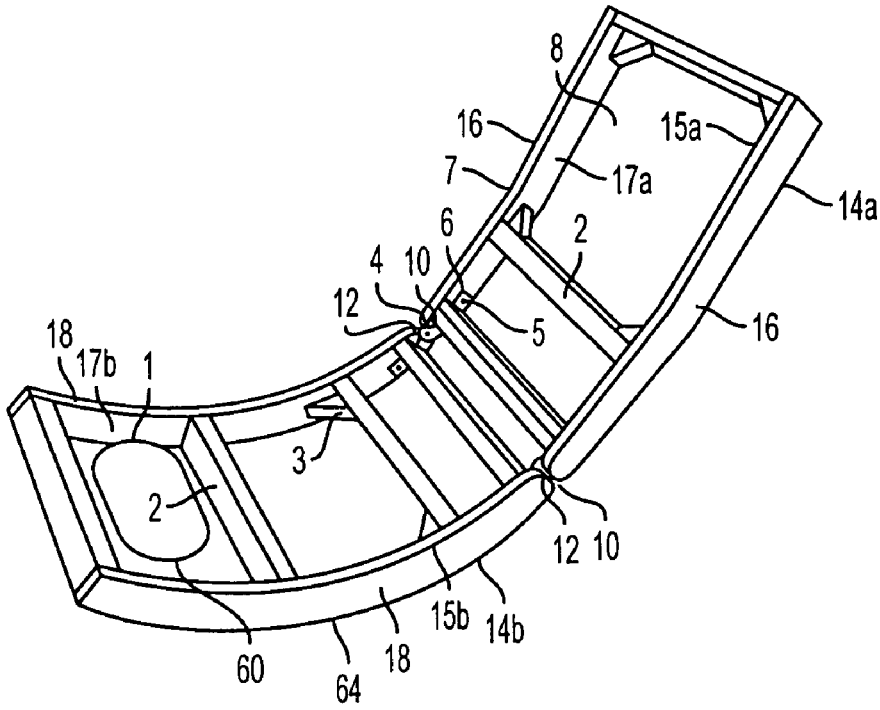
FIG. 1 is a perspective view of the erected position of the inventive folding rocking video lounge chair in which backrest and seat frames of the lounge chair extend transversely to one another.

Reference will now be made in detail to the embodiment of the invention that is illustrated in the accompanying drawings. Wherever possible, same or similar reference numerals are used in the drawings and the description to refer to the same or like parts or steps. The drawings are highly schematic and are not to precise scale. For purposes of convenience and clarity only, directional terms, such as top, bottom, inner, outer, side may be used with respect to the drawings. These and similar directional terms should not be construed to limit the scope of the invention in any manner. The words "attach," "connect," "couple," and similar terms with their inflectional morphemes do not necessarily denote direct and immediate connections, but also include connections through mediate elements or devices.

Figure 3:
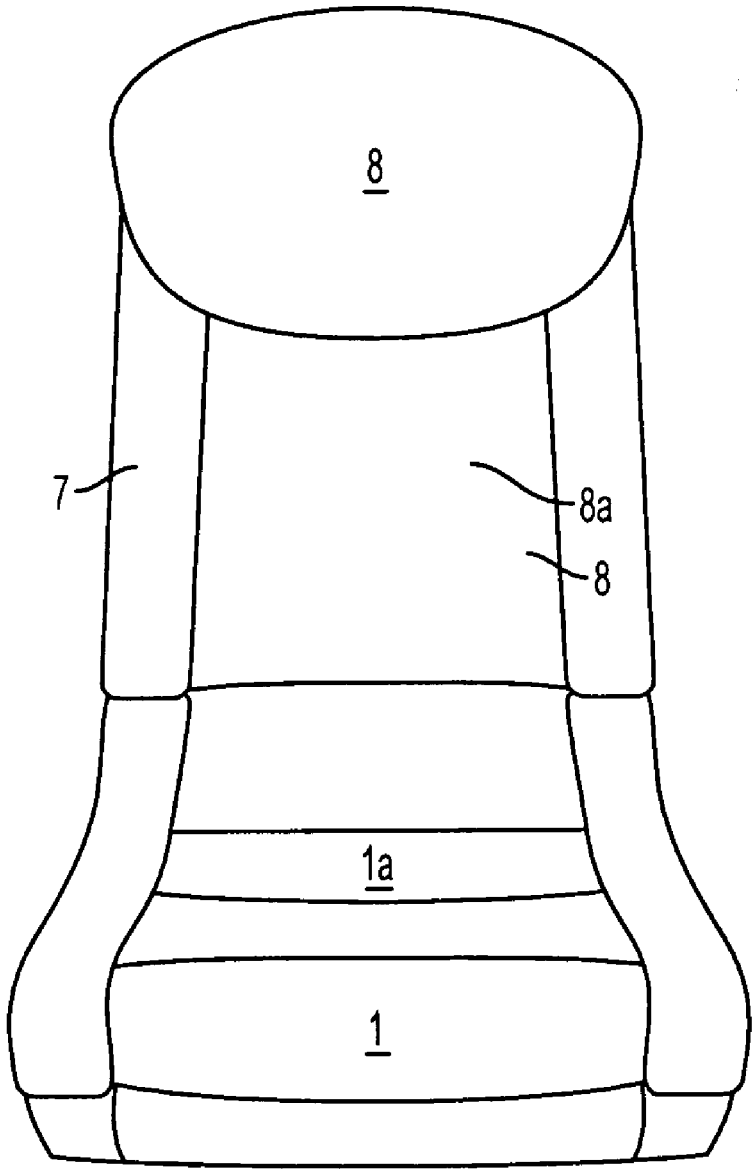
FIG. 3 illustrates the assembled and upholstered lounge chair in the erected position.

Referring to FIGS. 1 and 3, the inventive lounge chair includes, among other components, a seat frame 1 for a seat portion 1*a* and a backrest frame 8 for a back portion 8*a*, which are pivotally interconnected to move relative to one another between an erected and folded position. Backrest frame 8 is configured with two spaced-apart elongated side members 16 (FIG. 1) and a plurality of spaced crossbars 2, which extend between and connect opposing inner faces 17*a* of elongated side members 16. Seat frame 1 has a structure similar to backrest frame 8 and includes two elongated side members 18 coupled to one another by crossbars 2 and has at least one portion that is curved so that the lounge chair may rock and a substantially straight portion.

Triangular blocks 3 are configured to act as block and are rigidly attached to opposite ends of each of crossbars 2 to inner faces 17*b* of elongated members 18. Coupling frames 1 and 8 in a manner, which is described below, forms the inventive lounge chair having a simple, readily assembleable/disassemblable and esthetically appealing structure.

As shown in FIGS. 1 and 3, both frames 1 and 8, collectively frame members 7, i.e. seat portion 1*a* and back portion 8*a*, are ergonomically designed to conform to respective parts of the human body. In particular, elongated members 16 of backrest frame 8 each have a respective inner end portion 10 bridging the top and bottom surfaces 14*a* and 15*a* of these elongated members.

Figure 2:
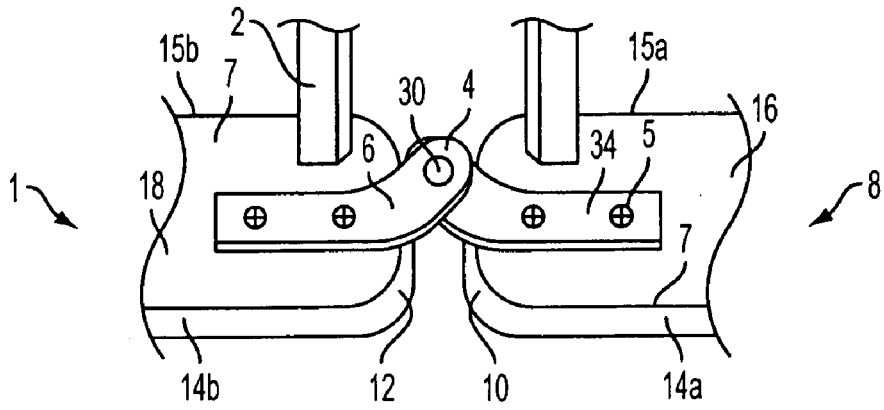
FIG. 2 is a side view of a coupling unit that connects the backrest and seat frames illustrated in FIG. 1.

Similarly, at least elongated members 18 of seat frame 1 each are slightly downwardly convex—having on portion that is curved so that the lounge chair may rock and a substantially straight portion—and have a respective bottom and top surfaces 14*b* and 15*b* (FIGS. 1 and 2), respectively, which are bridged by an inner end portion 12. In the erected position, inner end portions 10 of the backrest frame coextend complementary to and contact inner end portions 12 of the seat frame.

Figure 4A:
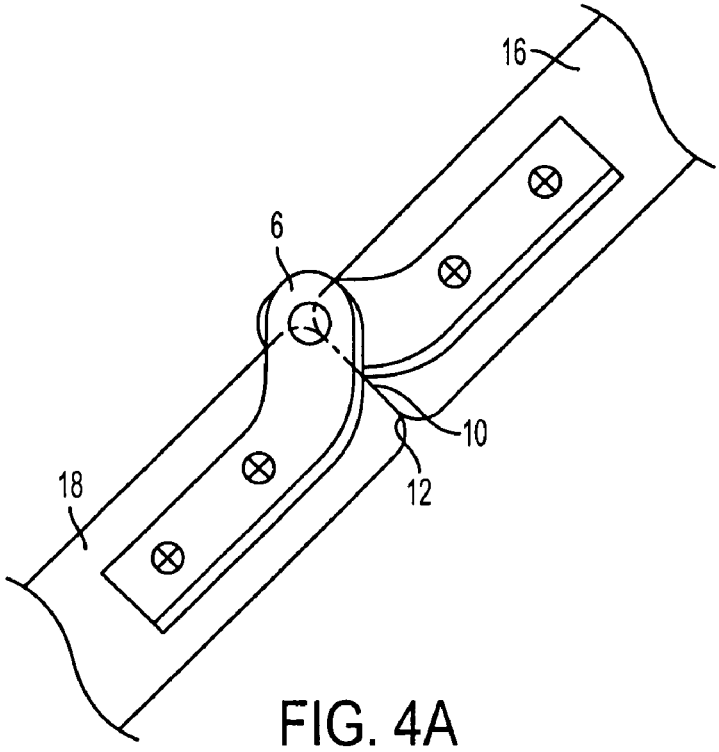
FIG. 4A is a side view of the inner portions of the backrest and seat frames, respectively, which are configured in accordance with one embodiment of the invention and shown in the erected position of the inventive lounge chair.
Figure 4B:
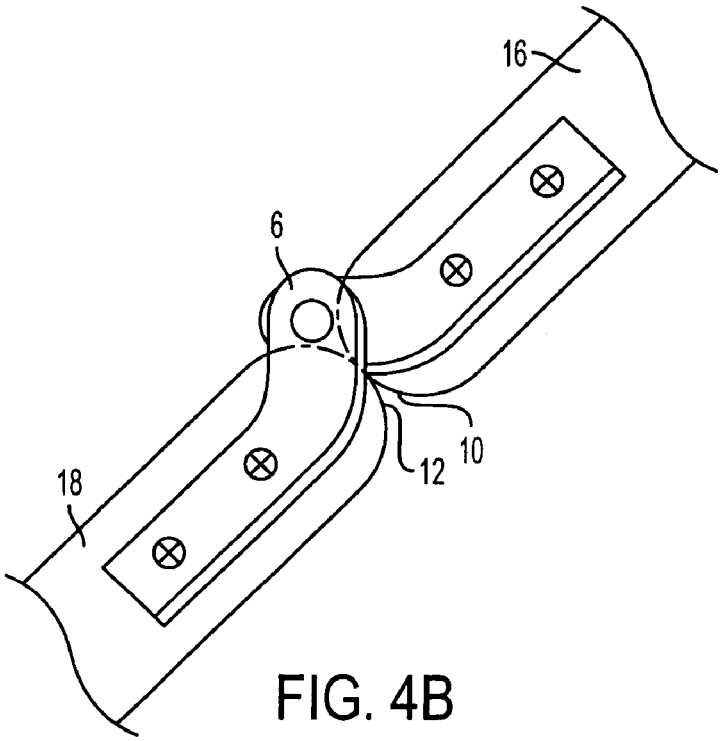
FIG. 4B is a side view of the inner end portions of the inventive lounge chair configured in accordance with a further aspect of the invention.

Thus, the contacting inner end portions 10 and 12 of the frames define a support for backrest frame 8 in the erected position. To provide reliable abutment of inner end portions 10 and 12, these portions may be rectilinearly slanted (FIG. 4A), curved (FIG. 4B) or have any another configuration, provided, of course, that these surfaces coextend complementary to one another in the erected position of the chair. As a consequence, when the user sits in the inventive lounge chair, it has a stable structure.

Inner end portion 10 and 12 (FIGS. 1, 4A and 4B) of each pair of elongated members 16 and 18, respectively, which abut one another in the erected positions of the rock chair, are pivotally interconnected by a coupling unit allowing seat and backrest frames 1 and 8, respectively, to rotate relative to one another. The coupling unit includes a plurality of hinges 6, each of which has a respective J-shaped or L-shaped cross-section defined by a generally rectangular outer end 34 and an arcuate inner end 30 (FIG. 2A) that extends at an angle to the outer end.

During assembly of the lounge chair, rectilinear outer end 34 of each hinge 6 is initially screwed by a respective, preferably, wooden screw 5 to the inner end portions of members 16 and 18 so that inner end 30 of attached hinge 6 extends upwards from respective bottom surface 14 of the elongated members in the erected position of the chair. A location of attachment of hinges 6 to the elongated members is so selected that inner curved ends 30 of hinges 6, which are to be coupled together, overlap. In this position, eyelets, each of which is formed on a respective inner end 30 of hinges 6 to be coupled (FIG. 2), are aligned with one another and further traversed by a respective pin 4. Since each pin 4 extends in a plane spaced laterally from a respective one of planes in which outer ends 34 of the hinges extend, pivoting of backrest frame 8 can be continued until its longitudinal members 16 extend substantially parallel to longitudinal members 18 of seat frame 1. As a consequence, in the collapsed or folded position of the lounge chair, it has a banana-like contour and is space-effective.

To improve stability of lounge chair in its erected position, seat frame 1 has a weight 60, which is made from a piece of cement or other material and mounted to the bottom of this seat portion 1*a*. Weight 60 interacts with seat frame 1 so as to balance the lounge chair, when erected, in an upright and inviting position having a pivot point 64 when not occupied by a user. Therein, pivot point 64 is the contact point between the floor and the lounge chair. Pivot point 64 is disposed closer to the back portion of the lounge chair than weight 60.

When a user enters the chair, seat frame 1 is so shaped that weight 60 counters at least partially the additional weight of the user until the user is seated. Therein, a chief advantage for an inattentive user is that such a user does not tumble backwards in the chair as he attempts to seat himself as is a common problem in low rocking chairs. Furthermore, when the user is seated, seat frame 1 and weight 60 act so as.

Figure 5A:
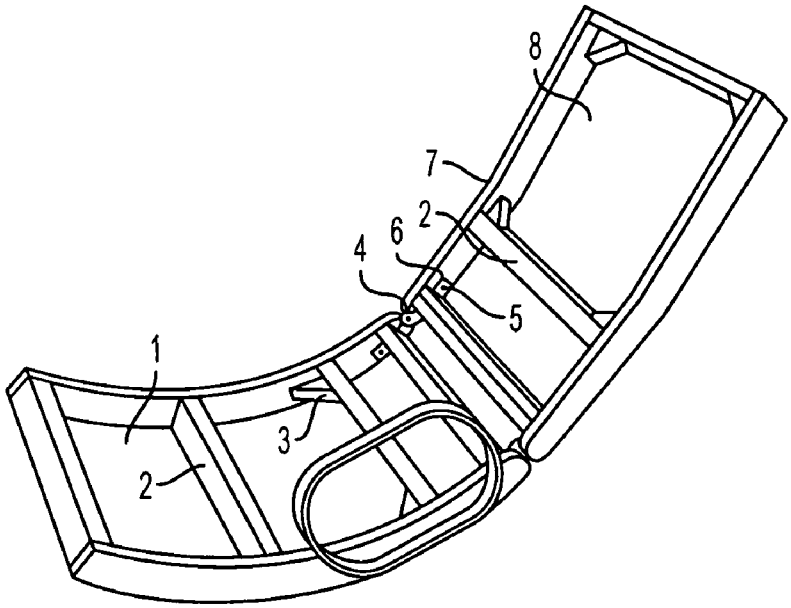
FIGS. 5A and 5B are views of one embodiment of the inventive lounge chair having armrests.
Figure 5B:
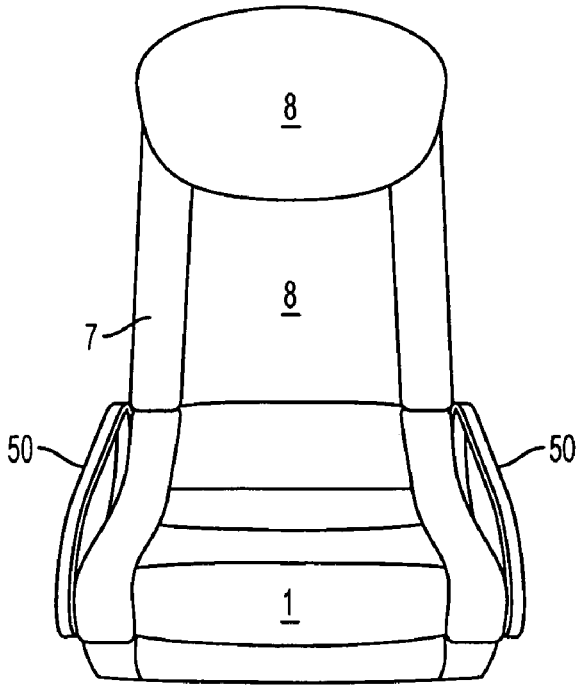
Figure 6A:
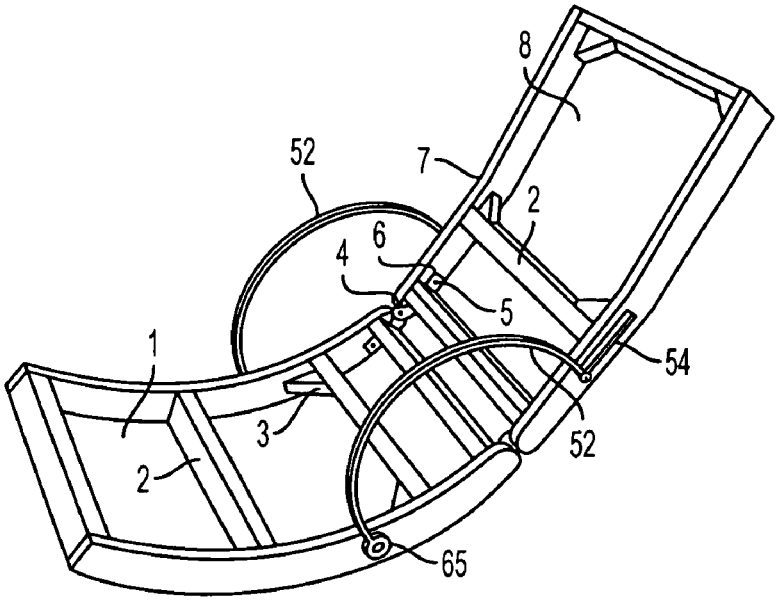
FIGS. 6A and 6B are views of a further embodiment of the inventive lounge chair having armrests.
Figure 6B:
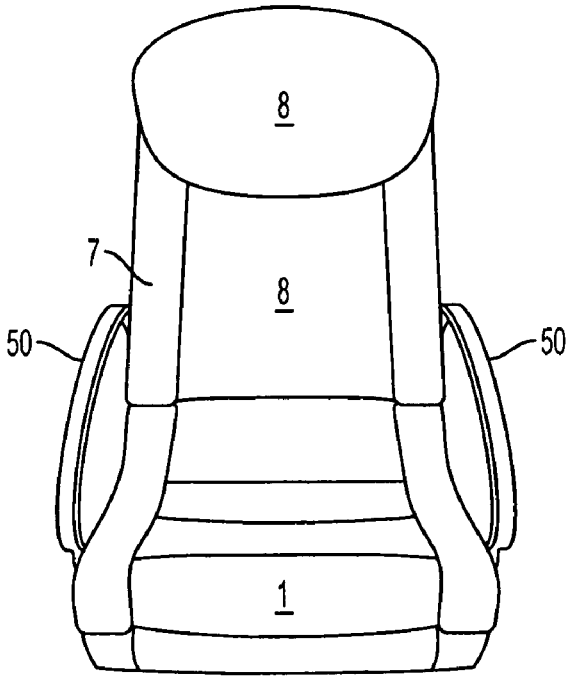

To provide the user with even more comfort, the lounge chair has a pair of armrests 50, only the near side armrest being shown, in FIGS. 5A and 5B in one embodiment and armrests 52 shown in FIGS. 6A and 6B in a further embodiment.

Armrests 50 are fastened to frame 18 and are spaced so that back portion 8*a* can be moved to the folded position without being interfered by armrests 50.

Armrest 52 is coupled to member 18 by fastener 65 so that the armrest 52 is rotatable about fastener 65. A recess 54 formed in elongated member 16. Armrest 52 is received either directly or through a fastener in recess 54. When the user moves backrest frame 8 to the folded position of the lounge chair, armrests 52 are guided through recesses 54, which are so dimensioned that displacement of backrest frame 8 is smooth during the entire folding operation. Therein, back portion 8*a* can be displaced to the folded position of the lounge chair without being interfered by armrests 52. Armrest 52 would then pivot about fastener 65 and simultaneously travel in recess 54 so as to permit more efficient storage.

Seat and backrest frames 1 and 8, respectively, can be made from different materials, which include, for example, wood, plastic, bamboo and metal. A layer of foam is then put on each of the frames, which further are upholstered with material including, but not limited to, leather, PVC and/or fabric.

Material covering the backside of backrest frame 8 may be provided with a pocket conveniently located and easily reachable by the user in case if he/she wants to either put something in or take it out from the pocket.

Once manufactured, the lounge chair may have a headrest and/or pillow, which is formed at the inner side of backrest frame 8.

This document describes the inventive lounge chair for illustration purposes only. Neither the specific embodiments of the invention as a whole, nor those of its features limit the general principles underlying the invention. In particular, the invention is not limited to any particular size or shape of the lounge chair or materials used for manufacturing this chair. The specific features described herein may be used in some embodiments, but not in others, without departure from the spirit and scope of the invention as set forth. Many additional modifications are intended in the foregoing disclosure, and it will be appreciated by those of ordinary skill in the art that in some instances some features of the invention will be employed in the absence of a corresponding use of other features. For example, longitudinal members may be rectangular, circular or have any other cross-section. The illustrative examples therefore do not define the metes and bounds of the invention.

What is claimed is:

1. A lounge chair comprising:

a backrest frame having a first and a second spaced elongated member, each member being provided with a respective inner end portion;

a seat frame having a first and a second spaced elongated member, each member being provided with a respective inner end portion, the first and the second spaced elongated members of the seat frame having a curved and a straight portion, respectively, the seat frame being pivotally coupled to the backrest frame to permit movement from a folded position, in which free ends of the backrest and seat frames are substantially next to one another, and an erected position, in which the backrest and seat frames extend transversely to one another, and the inner end portions of the first and second elongated members of the seat frame each extending complementary to and abutting a respective one of the inner end portions of the first and second elongated members of the backrest frame in the erected position; and a weight disposed in the seat frame between the first and the second spaced elongated members of the seat frame in substantially the straight portion for balancing the backrest frame and the seat frame when in the erected position when nor being used by a user and when being entered by a user to counterbalance a weight of the user.

2. The lounge chair of claim 1 further comprising an armrest fixedly connected to one of the first and the second spaced elongated members of the seat frame.

3. The lounge chair of clam 1 further comprising an armrest pivotally connected to one of the first and the second spaced elongated members of the seat frame and slideably connected to one of the first and the second spaced elongated members of the backrest frame.

4. The lounge chair of claim 1, wherein the inner end portion of the first and second elongated members of the backrest and seat frames, respectively, is carved.

5. The lounge chair of claim 1 further comprising a plurality of hinges each having a respective outer and inner end, the outer ends of the plurality of hinges each being mounted to a respective one of the first and second elongated members of the seat and backrest frames, respectively, so that the inner ends of the hinges, which are coupled to the first elongated members of the seat and backrest frames, respectively, are pivotally attached to one another, and the inner ends of the hinges, which are coupled to the second elongated members of the seat and backrest frames, respectively, are pivotally attached to one another.

6. The lounge chair of claim 5, wherein the inner ends of the plurality of hinges each extend angularly from a respective one of the outer ends, the inner ends of the hinges, which are coupled to the first elongated members of the seat and backrest frames, respectively, overlap one another, and the inner ends of the hinges, which are coupled to the second elongated members of the backrest and seat frames, respectively, overlap one another.

7. The lounge chair of claim 6 further comprising a plurality of pins each extending through and pivotally coupling a respective pair of the overlapped inner ends of the plurality of hinges.

8. The lounge chair of claim 7, wherein the inner ends of the plurality of hinges each have a respective eyelet, the eyelets of each pair of the overlapped inner ends of the plurality of hinges being aligned in the erected and folded positions of the backrest and seat frames and dimensioned to receive a respective one of the plurality of pins.

9. The lounge chair of claim 6, wherein the plurality of hinges each have a respective one of an L-shaped cross-section and a J-shaped cross-section.

10. The lounge chair of claim 1 further comprising a plurality of spaced apart crossbars extending between and coupled to the first and second elongated members of the backrest and seat frames, respectively.

11. The lounge chair of claim 10 further comprising a plurality of triangular reinforcements blocks each coupling a respective one of the plurality of crossbars to the first and second elongated members of the backrest and seat frames, respectively.

12. The lounge chair of claim 1, wherein the seat and backrest frames are made from material selected from the group comprising of wood, plastic, bamboo and metal.

13. The lounge chair of claim 12 further comprising a layer of foam coupled to each of the seat and backrest frames and a layer of material atop the layer of foam, the material selected from the group consisting of leather, velour and fabric.

14. The lounge chair of claim 1, wherein the weight is disposed in the seat frame at an underside.

* * * * *